US005941226A

United States Patent [19]

Marietta

[11] Patent Number: 5,941,226

[45] Date of Patent: Aug. 24, 1999

[54] BOW SIGHT

[76] Inventor: Charles F. Marietta, 19 Morely Dr., Norwalk, Ohio 44857

[21] Appl. No.: 08/966,895

[22] Filed: Nov. 10, 1997

Related U.S. Application Data

[63] Continuation of application No. 08/653,360, May 24, 1996, abandoned.

[51] Int. Cl.[6] ..... F41G 1/467

[52] U.S. Cl. ..... 124/87; 33/265

[58] Field of Search ..... 33/265; 124/87

[56] References Cited

U.S. PATENT DOCUMENTS

| | | | |
|---|---|---|---|
| 2,545,454 | 3/1951 | Fredrickson | 33/265 |
| 2,925,656 | 2/1960 | Genovese | 33/265 |
| 3,137,755 | 6/1964 | Smith | 33/265 X |
| 3,284,904 | 11/1966 | Rade | 33/265 |
| 3,355,809 | 12/1967 | Guyton | 33/265 |
| 3,521,362 | 7/1970 | Duplechin | 33/265 |
| 4,020,560 | 5/1977 | Heck | 33/265 |
| 4,136,461 | 1/1979 | Gasser | 33/265 |
| 4,543,728 | 10/1985 | Kowalski | 33/265 |
| 5,384,966 | 1/1995 | Gibbs | 33/265 |
| 5,414,936 | 5/1995 | Sappington | 33/265 |
| 5,479,712 | 1/1996 | Hargrove et al. | 33/265 |
| 5,575,072 | 11/1996 | Eldridge | 33/265 |

*Primary Examiner*—John A. Ricci
*Attorney, Agent, or Firm*—Jerry Semer

[57] ABSTRACT

The invention is a highly precise sight for archery. The invention uses a C-frame that is attached to the bow by a bar. Across the open area of the C a blade is attached. The blade contains a rack and along the blade runs a gauge on the rack. For an archer to sight he moves the gauge up and down the blade which moves the sight up and down. The archer can precisely measure to one thousandths of an inch from the gauge. Thus if an archer wishes to reposition his sight to the exact location within a thousandth of an inch all that is necessary is that he write down or remember the gauge readout. In one embodiment of the invention the gauge is analog. In another embodiment of the invention the gauge is digital. The sight also has a windage adjustment that can also be adjusted down to one thousandths of an inch. To get the accuracy down to one thousandth of an inch for this elevation and still manufacture the sight inexpensively, applicant used the parts from mass produced calipers. He takes a regular caliper with the jaws removed using only the blade and the gauge and places it in a c-shaped frame that attaches to the bow, and mounts the scope housing to the gauge of the caliper.

2 Claims, 6 Drawing Sheets

Dial Read-Out Model

A:A

B:B

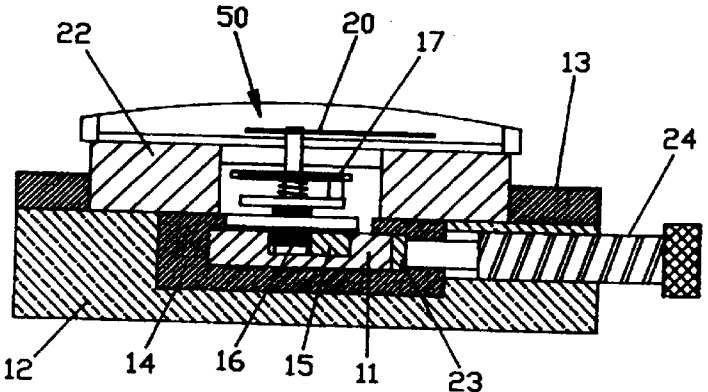
D:D Figure 5
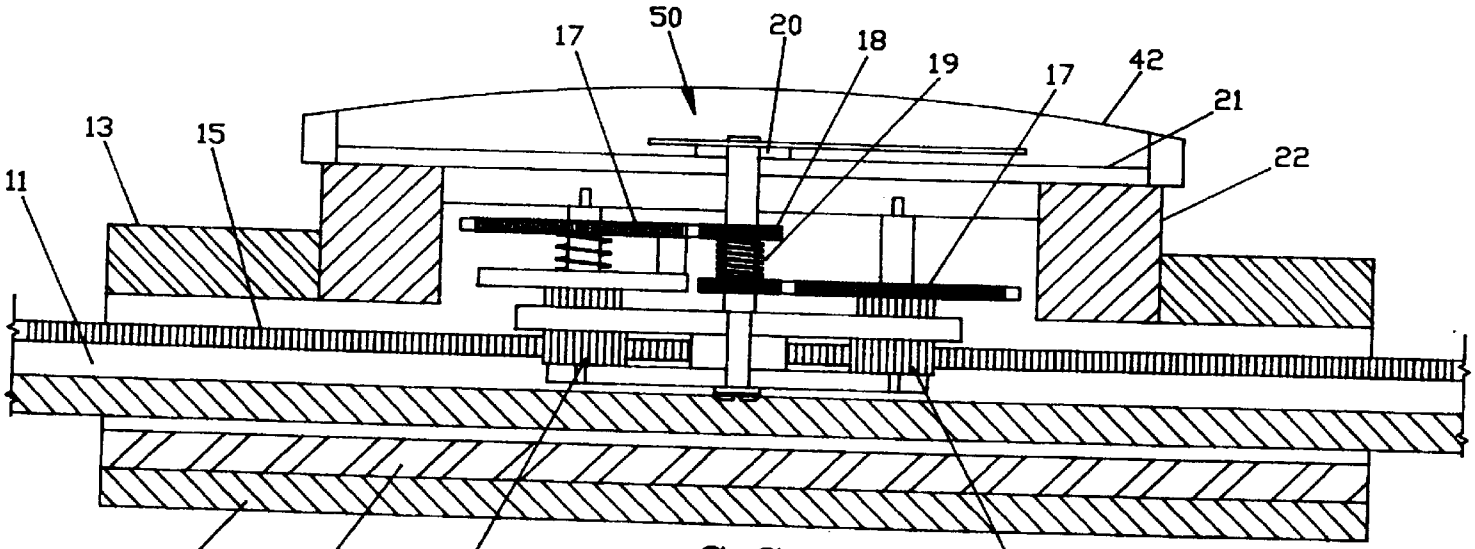
C:C Figure 4

Sight Scale

.001" On Dial
.050" And .100" Graduations

Windage Assembly

Dial Layout

BOW SIGHT

This is a continuation of application Ser. No. 08/653,360 filed on May 24, 1996 now abandoned.

FIELD OF THE INVENTION

This invention relates to a bow sight for archery bows.

BACKGROUND OF THE INVENTION

Most archery bows use a various types of sighting devices such as a scope sight or a pin sight. These sights are usually installed on the bow above the arrow rest. These sights usually can be moved vertically for proper aiming of the bow. Some sights can also be moved horizontally to take into account the horizontal movement of the arrow. This is called windage. There are numerous designs to move the sight in the vertical position to take into account the distance one is from the target. The most basic design is shown in U.S. Pat. No. 3,355,809 to G. B. Guyton. On this device the sight is moved in a vertical position along a rack by a pinion. U.S. Pat. No. 5,384,966 to Gibbs shows a very similar design for a bow sight. In this case you have a C-shape frame that supports a vertical screw and the sight is moved up and down along the vertical screw.

The main problem with both of these sights is that neither of them can be adjusted precisely enough for the archer. Thus, one of the main objects of this invention is to devise a bow sight that can be precise down to a one thousandth of an inch. Second, although the patent to Gibbs does show a ruling there is no effective way to keep track of the sighting position that is necessary for the archer. Thus, the objective of this invention is to place a meter on the bow sight so that the archer would know the precise location of his sight down to a one thousandth of an inch. As pointed out above, rulings have been used along the side of the sight however, most of these rulings do not measure down to a one thousandth of an inch. Many sights in their instructions for use call for the archer to place a pencil line at the point where the sight is located. This is not a very accurate method in that a pencil line is usually larger than a one thousandth of an inch. Most pencil lines are over ten thousandths of an inch. Thus, the inventors have incorporated a meter to measure the precise location down to an one thousandth of an inch where the sight islocated.

In competitive meets the archer has to shoot at a set of targets in differing orders. The archer needs to know the exact position of his bow sight so that when he returns to shoot at the same target again he can place the bow sight in that exact position. Thus, one of the objectives of this invention is to give the archer a readout of the exact position of his bow sight. As I stated above several bow sights just state that you should put a pencil line at the point where the sight is located. However as I pointed out above this pencil line is clearly larger than ten thousandths of inch and thus leads to an inaccuracy in the sighting. Therefore one of the objectives of this invention is to allow archers to return to the exact position down to one thousandths of an inch of where their sight was previously.

The feature that achieves this is a dial or digital readout. In one embodiment the applicant has created a dial readout that reads down to one thousandths of an inch. Thus, the archer only needs to write down his readout and he can return to that readout at any time. In the other embodiment the archer has a digital readout down to one thousandths of an inch. Here to he can just write down the readout and return to that position at any time.

Applicant has devised a way to make his bow sight highly accurate yet inexpensive. The feature that enables him to do this is that he modifies a dial or digital caliper to work as the gauge and blade. By attaching a scope to a dial or digital caliper gauge and blade enables him to create a highly accurate yet inexpensive and easy to manufacture sight.

SUMMARY OF THE INVENTION

The invention is a highly precise sight for archery. The invention uses a C-frame that is attached to the bow by a bar. Across the open area of the C a blade is attached. The blade contains a rack and along the blade runs a gauge on the rack. For an archer to sight he moves the gauge up and down the blade which moves the sight up and down. The archer can precisely measure to one thousandths of an inch from the gauge. Thus if an archer wishes to reposition his sight to the exact location within a thousandth of an inch all that is necessary is that he write down or remember the gauge readout. In one embodiment of the invention the gauge is analog. In another embodiment of the invention the gauge is digital.

The sight also has a windage adjustment that can also be adjusted down to one thousandths of an inch. To get the accuracy down to one thousandth of an inch for this elevation and still manufacture the sight inexpensively, applicant used the parts from mass produced calipers. He takes a regular caliper with the jaws removed using only the blade and the gauge and places it in a c-shaped frame that attaches to the bow, and mounts the scope housing to the gauge of the caliper.

BRIEF DESCRIPTION OF THE DRAWINGS

FIG. 4 is a sectional diagram along line c—c of FIG. 1 showing the insides of the gauge.

FIG. 5 is a sectional drawing along line d—d of FIG. 1 showing the insides of the gauge.

DETAILED DESCRIPTION OF THE PREFERRED EMBODIMENT

Figure 1:
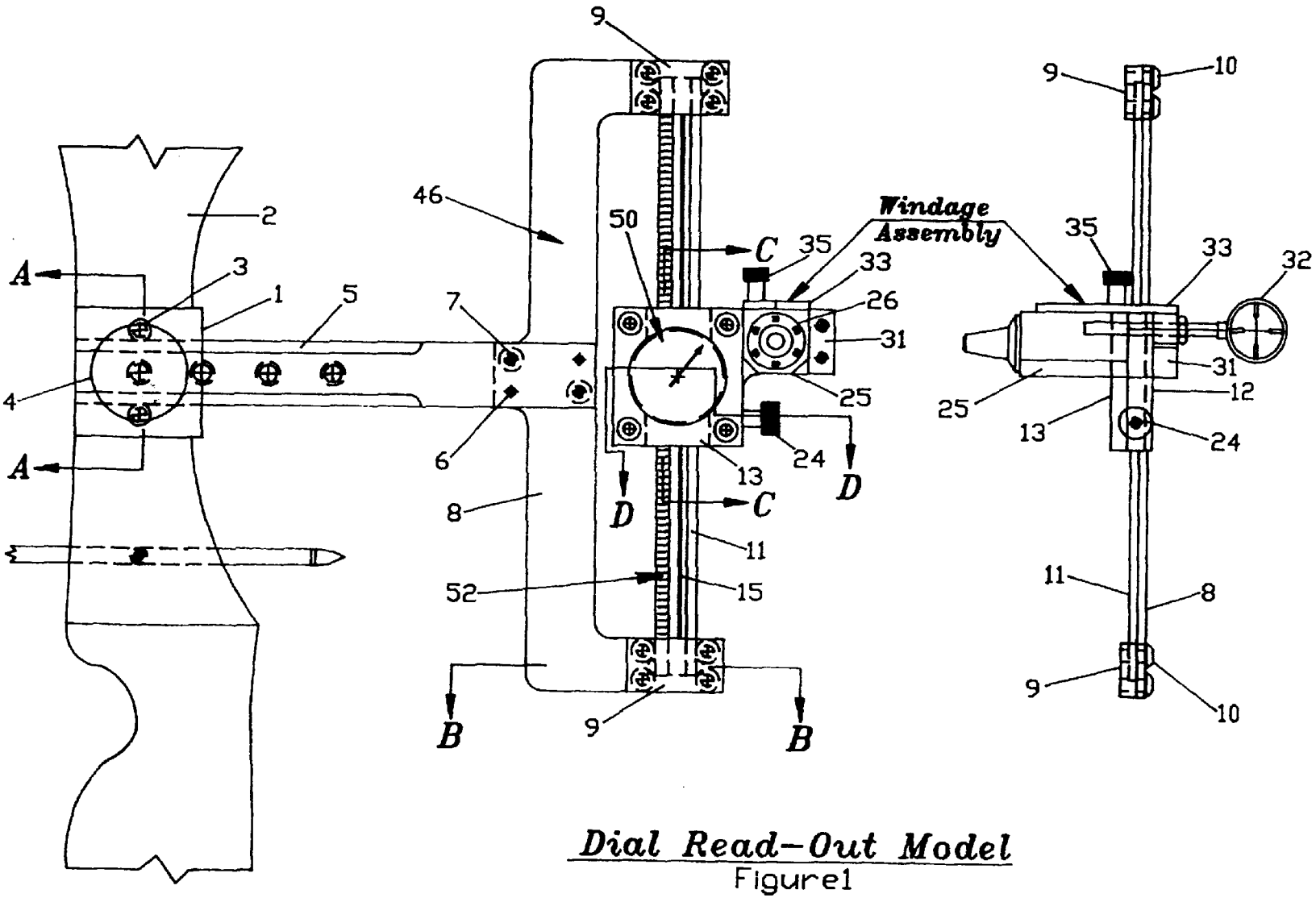
FIG. 1 is a side view of the sight as it is attached to the bow.

FIG. 1 shows a side view of the sight 46 as it is attached to the bow. FIG. 1 shows the bow handle riser 2 with the sight 46 attached to the bow just above the hand-grip.

Figure 2:
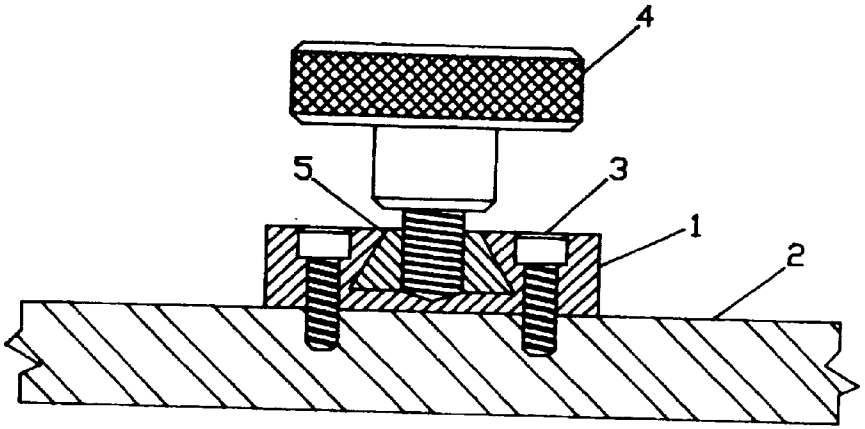
FIG. 2 is a sectional drawing along line a—a of FIG. 1 showing the dovetail mounting block.

The sight 46 is attached to the bow handle riser 2 by the following method. A dovetail mounting block 1 is attached to the bow just above the hand-grip. FIG. 2 is sectional drawing along line a—a of FIG. 1 showing how the dovetail mounting block is mounted. In viewing FIGS. 1 and 2 one can see that the dovetail mounting block 1 is attached to the bow with two screws 3 that fit through the block and into the bow's structure. FIG. 2 also shows that a trapezoidal rabbit is cut across the top of the dovetail mounting block 1. This rabbit is adapted to fit the dovetail bar 5 at one end of the end of the dovetail bar 5. A dovetail clamp knob 4 passes through a threaded opening in the dovetail bar 5. The dovetail bar 5 is placed in the trapezoidal rabbit of the dovetail mounting block 1 at a point where when the dovetail clamp knob is screwed through the dovetail bar 5 the dovetail clamp knob 4 makes contact with the dovetail mounting block 1. By tightening the dovetail clamp knob down against the dovetail mounting block the dovetail bar 5 is held securely in place. At the end of the bar opposite the end with the dovetail clamping knob 4 is the sight 46. There are many other ways known in the art to attached the sight to the bow. Any of these ways could be used to attach the inventors sight 46 to the bow.

Dovetail bar 5 is attached to the sight 46 by a set of screws 7 and dowel pins 6. There are also many other ways known in the art in which the dovetail bar 5 could be attached to the sight 46.

Figure 3:
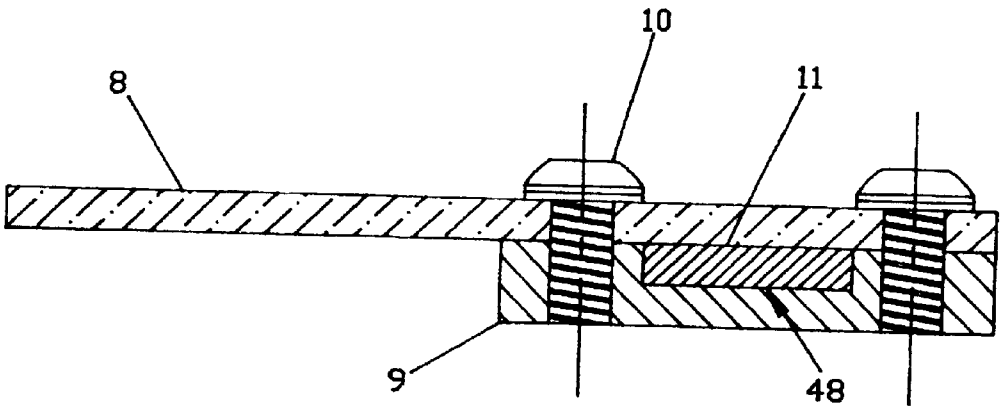
FIG. 3 is a sectional view along line b—b of FIG. 1 showing the end of the c-shaped bracket, the blade and the clamping block.

The sight 46 consists of a c-shaped bracket 8. Across the opening of the c-shape bracket 8 a blade 11 is attached to the ends of the c-shaped bracket 8. Down the center of blade 11 is a gear rack 15. The blade 11 is attached to the c-shaped bracket 8 by clamping block 9 and screws 10. FIG. 3 shows that clamping block 9 has a clamping block groove 48 in which the blade 11 fits. Screw 10 pass through the c-shaped bracket 8 and into threaded openings in clamping block 9. When screws 10 are tightened down the clamping block tightness down on blade 11 and holds the blade 11 securely in place.

A gauge 50 which engages the gear rack 15 on the blade 11. This gauge 50 in the preferred embodiment can be moved easily up and down blade 11. The gauge 50, engage the gear rack 15 on the blade 11. FIGS. 4 and 5 show how gear rack 15 engages the gauge 50 on the blade 11. The blade 11 gear rack 15 engages drive gear 16 of gauge 50. When gauge 50 is moved slightly the teeth of gear rack 15 move slightly in the teeth of drive gear 16 causing drive gear 16 to move slightly. Drive gear 16 is attached to intermediate gear 17 and when drive gear 16 moves intermediate gear 17 moves. The teeth on intermediate gear 17 engage the teeth of center dial gear 18. Thus when drive gear 17 moves center dial gear 18 also moves. Center gear 18 is attached to needle 20 of gauge 50. Thus when center gear 18 moves the needle 20 on gauge 50 also moves. Therefore when gage 50 moves on blade 11 the needle 20 on gauge 50 moves. In the preferred embodiment this gauge 50 can measure down to a thousandth of an inch movement. In the preferred embodiment along gear rack 15 runs a scale 52. The gauge 50 also has numerical marking for readout of the movement of the gauge 50 along blade 11 on the gauges dial face 21. The archer first reads the position on the scale 52 and then the reading on dial face 21. By using these two readings the archer can measure the movement of the scope 32 in the vertical plane down to one thousandths of an inch in the preferred embodiment.

Figures 6, 6A, 6B, 6C, 6D, 6E, 6F, 6G:
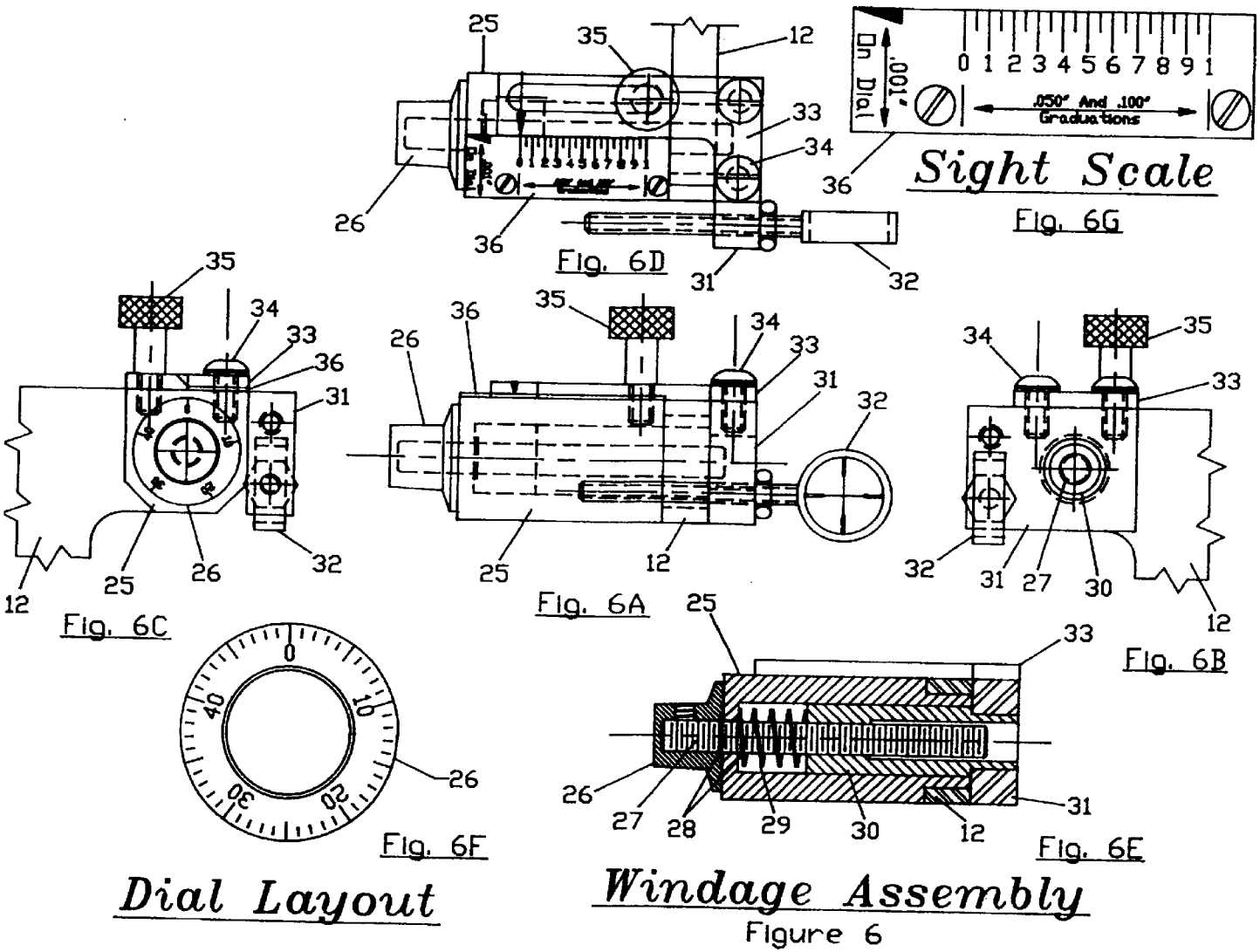
FIG. 6 is a plain view of the windage assembly.
FIG. 6*a* is a side of the windage assembly.
FIG. 6*b* is a back view of the windage assembly.
FIG. 6*c* is a front view of the windage assembly.
FIG. 6*d* is a top view of the windage assembly.
FIG. 6*e* is a view sectional of the scale on the windage assembly.
FIG. 6*f* is a view of the dial on the windage assembly.
FIG. 6*g* is a view of the scale on the windage assembly.

An archer needs not only to be able to adjust his sight as to elevation he also has to adjust his sight horizontally. This is called windage. The windage adjustment is horizontal rather than the elevation adjustment of vertical. FIGS. 6*a, b, c, d, e, f*, and *g* show the windage adjustment system in the preferred embodiment. The windage adjustment is made by turning windage dial 26. Windage dial 26 is attached to windage housing 25 which in the preferred embodiment is attached to gauge 50. The windage dial 26 is also attached to the windage screw 27. The windage screw 27 is attached to the windage slide tube 30 which is attached to the scope 32. Thus when windage screw 27 moves it moves scope 32. If the horizontal movement of windage screw 27 in the preferred embodiment corresponds exactly to the movement of scope 32. In the preferred embodiment one turn of dial 26 moves the scope fifty thousandths of an inch. Thus, twenty turns of dial 26 moves windage screw 27 and the scope one inch. The dial as one can see from FIG. 6*f* is marked from 1 to 50. Thus each mark on the dial represents the thousandths of an inch movement of the windage screw 26 in the horizontal direction and of the sight. FIG. 6*g* shows the sight scale 36. Sight scale 36 lies on top of the windage body 25 and shows readings in 0.05 inches and one tenth inch increments to one inch. Thus this windage scale 36 shows twenty turns of dial 26. Each mark on the windage scale represents one turn of dial 26. The clamping bar 33 is marked with an arrow that moves along the scale.

Figures 7, 8:
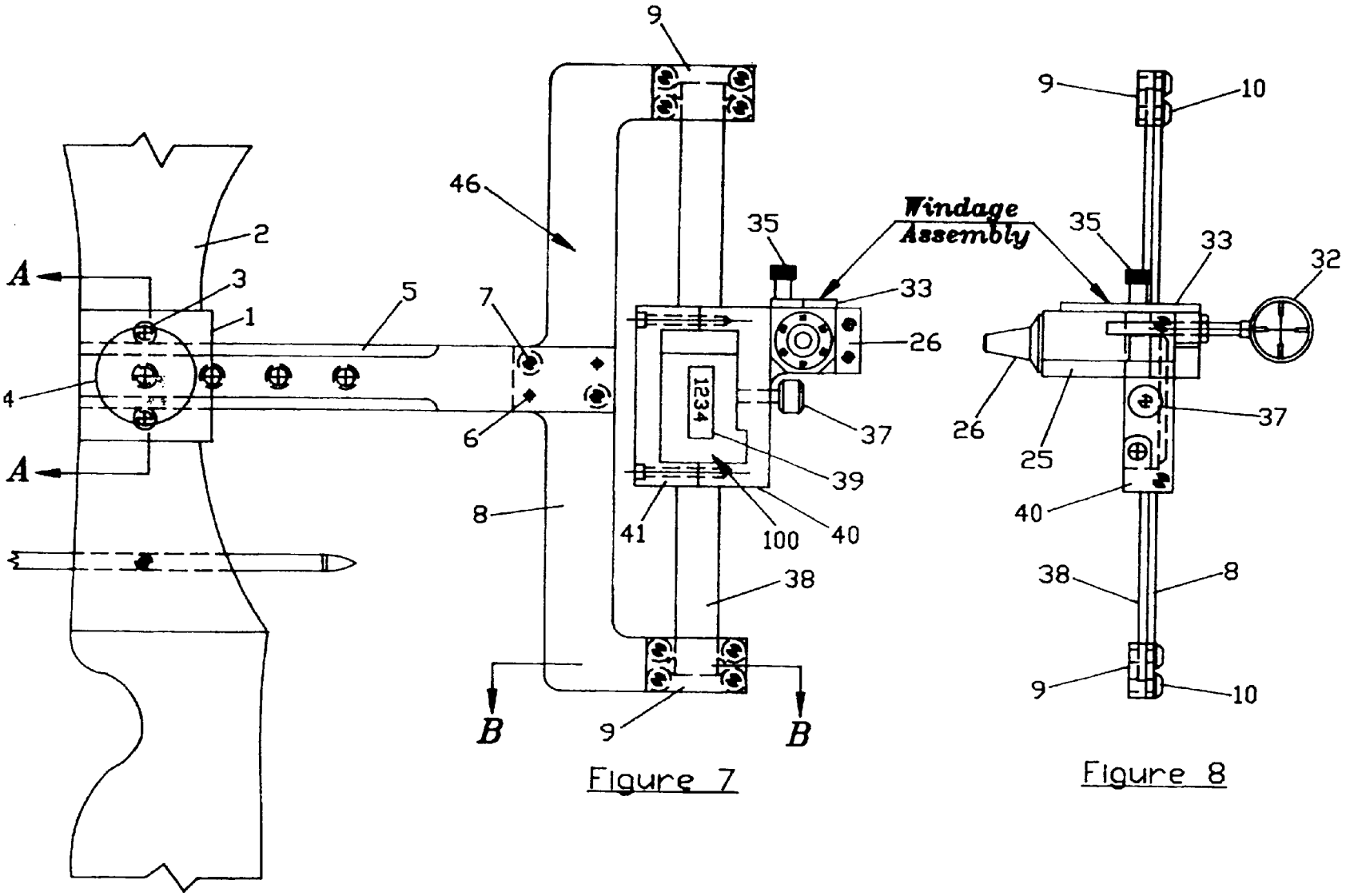
FIG. 7 is a side view of the invention with a digital readout.
FIG. 8 is a front view of the invention with a digital readout.

FIGS. 7 and 8 show another embodiment of the invention. This embodiment works exactly the same as the first embodiment except the readout on the gauge 100 is digital rather than analog. The digital readout can be down to one thousandths of an inch. In this embodiment the gauge 100 is moved along blade 38 and the distance of movement is measured electronically and place upon the gauge 100 in digital fashion. This gauge 100 as stated before can measure down to one thousandths of an inch.

A person that is using the sight 46 to align target would first move the gauge 50 up and down to the exact location he/she would want. By reading the gauge 50 and the scale 52 one can precisely know to a thousandths on an inch the position of the scope 32. If this position is written down one can easily return to that position. Once the gauge 50 is in the position, screw knob 24 is tightened down to hold the gauge in position. Then one adjusts the windage by moving dial 26. One moves dial 26 to the exact position and then tightens down knob 35 to hold the scope 32 in that position. If one writes down the measurements on the sight scale 36 and the dial 26 one will have the precise location to a thousandths of an inch. This can be written down and the archer can return to the same position in the future easily. The second embodiment shown in FIGS. 7 and 8 works precisely the same way as the first embodiment. Although, in this embodiment your read out of your dial is digital. Thus an individual would only have to write down the digital positioning to a thousandth of an inch so he could return to precisely the same point in his next shoot at the same target.

Figure 10:
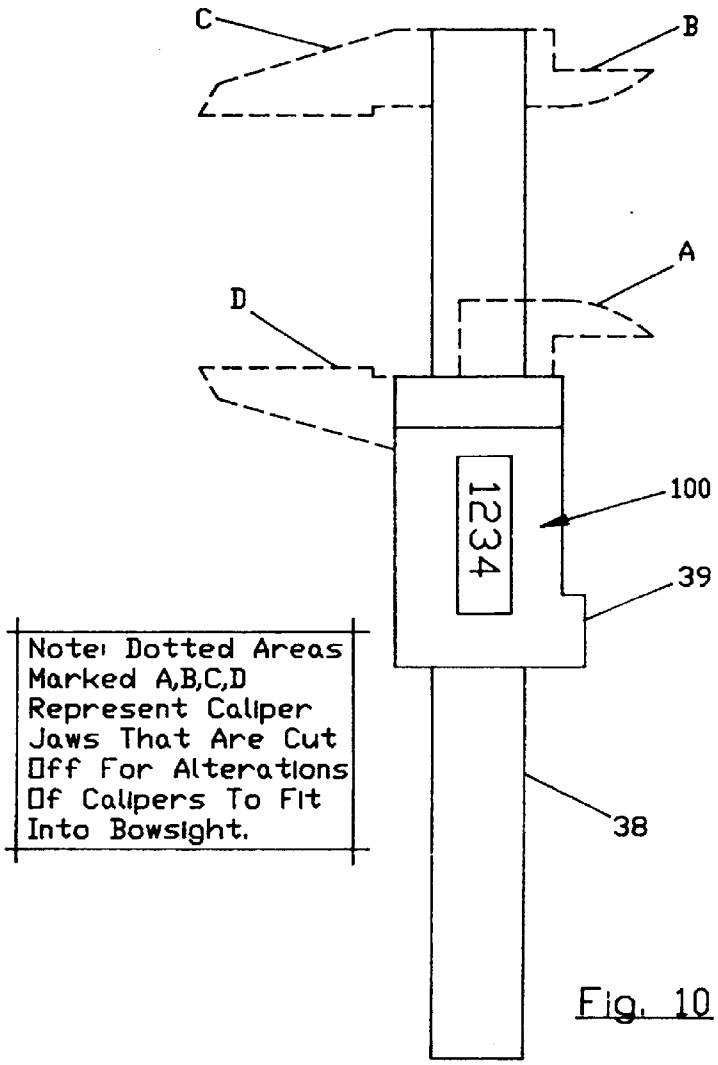
FIG. 10 is a view of the blade and gauge of the digital readout with the jaws of the caliper represented in phantom.
Figure 9:
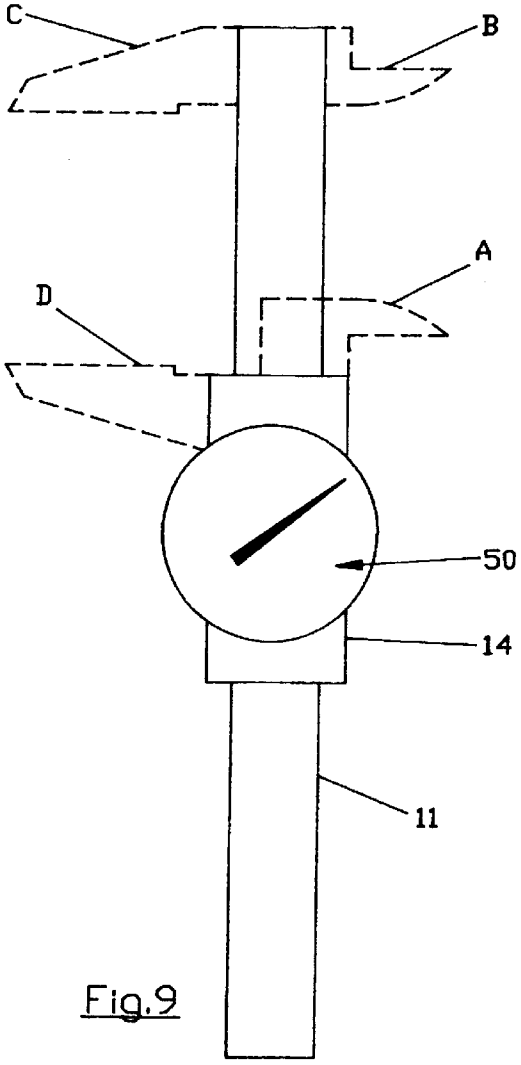
FIG. 9 is a view of the blade and the gauge with the jaws of the caliper represented in phantom.

To make his sight inexpensive yet accurate down to one thousandths of an inch the inventor has used digital calipers on the market that measure to one thousandths of an inch. His modifications of the digital caliper are shown in FIG. 9 and FIG. 10. Figure one shows a dial caliper 52. Applicant takes the dial caliper 52 and removes its jaws a, b, c, and d that are shown in dotted lines. After removal of the jaws a, b, c, and d the only parts remaining of the caliper are the gauge 50 or 100 and the blade 11 or 38. Then applicant mounts scope 32 on the gauge 50 or 100. In the preferred embodiment the scope 32 is actually mounted on the windage assembly which is mounted on the gauge 50 or 100. However the scope 32 could easily be mounted on the gauge itself. In the preferred embodiment the windage assembly is first mounted on the gauge 50 or 100 and then scope 32 is mounted on the windage assembly.

I claim:

1. A bow sight comprising:

a. a bar with two ends;

b. a C-shaped bracket with an opening of the C and a back side, said C-shaped bracket being attached to one of the ends of said bar in the middle of the back side of the C-shaped bracket;

c. a blade with a gear rack extending along the blade's length attached to the C-shaped bracket across the opening of the C and said blade's gear rack has a first scale;

d. a gauge with a first circular dial and a needle, attached to the blade's gear rack such that it can be moved up and down the blade;

e. a means for moving the needle in correspondence with the movement of the gauge along the blade;

f. a first means for holding the gauge in the vertical position on the blade;

g. a scope attached to the gauge for sighting one's target;

h. a means for attaching the sight to the bow just above the hand grip;

whereby, an individual attaches the sight to the bow by the means for attaching the sight to the bow and then one aligns the target through the scope by moving the gauge up and down the blade, and when the target is sighted perfectly, the gauge is then held in place by the first means for holding the gauge in place and a reading down to 1/1000 of an inch as to the position of the scope can be made by reading the first scale on the blade and the position of the needle on the gauge; and, means for adjusting the scope in a horizontal direction, comprising:

i. a housing attached to the gauge;

j. a second circular dial with numerical markings that tell how far the dial has been turned attached to the housing;

k. a second linear scale attached to the housing;

l. a screw attached to the second dial that is linked to the scope such that when the second dial is turned, the screw turns and the screw moves the scope in a horizontal plane;

m. an arrow attached to the screw such that when the screw moves, the arrow will move and said arrow moves along the second linear scale;

n. a second means for holding the scope in the horizontal position once the target has been sighted;

whereby, an individual moves the sight in the horizontal position by moving the second dial, and when one places the sight in the exact position, one tightens the sight in position by the second means for holding.

2. A bow sight as in claim 1 wherein:

a. the individual can measure the movement of the scope in the horizontal direction down to one thousandth of an inch by reading the second linear scale and the second dial.

* * * * *